US007260341B2

(12) United States Patent
Chang

(10) Patent No.: US 7,260,341 B2
(45) Date of Patent: Aug. 21, 2007

(54) CLEANING PATCH FOR AN IMAGE FORMING APPARATUS

(75) Inventor: Shih-Liang Chang, Hsinchu (TW)

(73) Assignee: Aetus System Incorporated, Hsinchu (TW)

( * ) Notice: Subject to any disclaimer, the term of this patent is extended or adjusted under 35 U.S.C. 154(b) by 0 days.

(21) Appl. No.: 11/337,621

(22) Filed: Jan. 23, 2006

(65) Prior Publication Data

US 2007/0172249 A1 Jul. 26, 2007

(51) Int. Cl.
*G03G 15/00* (2006.01)

(52) U.S. Cl. ..... 399/99; 399/149; 399/222; 399/249; 399/273; 399/283

(58) Field of Classification Search ..... 399/99, 399/222, 264, 249, 98, 53, 273, 283, 149
See application file for complete search history.

(56) References Cited

U.S. PATENT DOCUMENTS 6,687,473 B2 * 2/2004 Wang et al. ..... 399/99

FOREIGN PATENT DOCUMENTS

JP 63303384 A * 12/1988

* cited by examiner

*Primary Examiner*—David M. Gray
*Assistant Examiner*—Geoffrey T Evans
(74) *Attorney, Agent, or Firm*—Thomas, Kayden, Horstemeyer & Risley

(57) ABSTRACT

The present invention discloses a cleaning patch and method thereof for cleaning a residual toner in a developing unit. The cleaning patch is composed of a plurality of cleaning regions. Each cleaning region includes a plurality of cleaning toner point alternately arranged in a row, which may reduce the absorbed toner in each cleaning region to improve the image quality.

12 Claims, 3 Drawing Sheets

CLEANING PATCH FOR AN IMAGE FORMING APPARATUS

BACKGROUND OF THE INVENTION

1. Field of Invention

The invention relates to a cleaning patch and method thereof for cleaning a toner. More explicitly, the invention pertains to a cleaning patch and method thereof for cleaning a residual toner in a developing unit.

2. Related Art

Electrophotographic image systems utilize the principle of ElectroPhotoGraphy (EPG) to print images. The EPG involves several steps: charging, exposure, developing, transferring, and fusing.

When the image forming device prints an image, a high-voltage corona charging unit distributes negative charges all over the surface of a photoreceptor. This is the charging step. In the exposure step, the image to be printed is converted into an optical signal and irradiated using a light-emitting diode (LED) or a laser on the photoreceptor that is already charged with negative charges. The irradiated region has a higher potential than the un-irradiated region. Such a potential difference is used to represent the potential image, also called the latent image.

The developing step starts right after the required latent image is formed on the photoreceptor. The developing unit has the toners with the same potential as the un-exposed region. The toners cannot adhere onto the un-exposed region due to the repulsive electrostatic force. However, they are attracted to the exposed region with a higher potential. Therefore, the exposed region is disposed with toners.

Once the developing step is finished, the toners adhered on the photoreceptor are transferred to paper. This is the transferring step. In this step, a transfer roller is used to distribute positive charges on the back of the paper. Thus, the toners on the photoreceptor are transferred onto the paper. Finally, a heat roller and a pressure roller are used to fix the toners on the paper. This is the fusing step. A cleaning station then cleans the cleaning patch on the photoreceptor after transferring step.

In order to prevent the residual toners from a previous developing from affecting the current developing, the photoreceptor can be provided with a cleaning patch during the developing step, as disclosed in U.S. Pat. No. 6,687,473. That patent only discloses the idea of effectively removing possible residual toners in order not to pollute the developing step, thus improving the image quality. It does not explicitly disclose the implementation method.

Therefore, it is imperative to provide a method that can evenly distribute residual toners on a cleaning patch in order not to pollute the developing step and increase the efficiency of the cleaning station to remove the toner from the photoreceptor.

SUMMARY OF THE INVENTION

An objective of the invention is to provide a method for cleaning residual toners on a developing unit. This effectively avoids the pollution of residual toners and improves the image quality.

Another objective of the invention is to provide a cleaning patch for the residual toners to evenly distribute thereon. The cleaning efficiency of removing the toner from the cleaning patch is then increased by evenly distributed toner.

In accord with the above objectives, the disclosed cleaning patch includes several cleaning regions. The cleaning regions are disposed alternately on a photoreceptor to effectively absorb the residual toners thereon. The positions of the cleaning regions are predetermined through the settings of the image forming device.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

The invention provides a cleaning patch for absorbing residual toners on a developing unit possibly produced during a printing process. Different cleaning patches may be used to reduce variations in the toner absorption ability of individual cleaning patches. In the following, a color electrophotographic image system with two sets of exposure elements is taken as an example to explain the invention. Nevertheless, the invention is not limited to this particular case.

Figure 1:
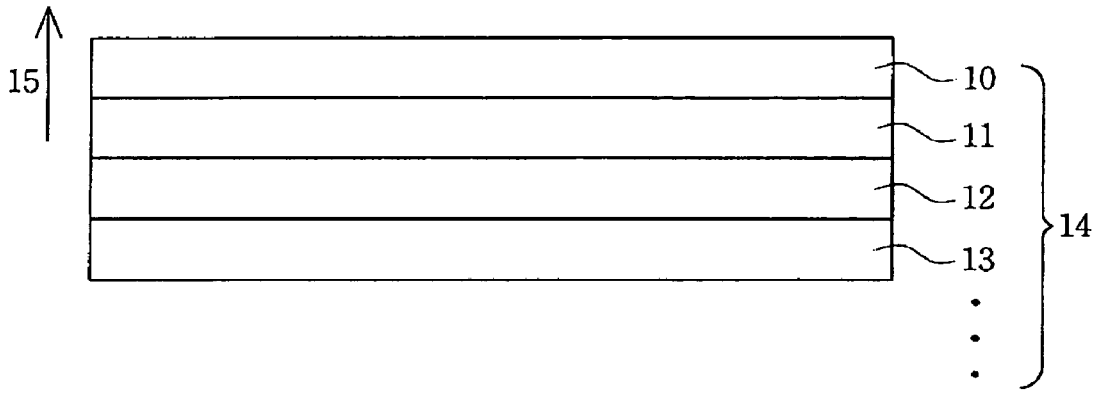
FIG. 1 is a schematic view of the disclosed cleaning patch.

As shown in FIG. 1, the front end of a latent image on a photoreceptor is disposed with a cleaning patch 14 of several stripe patterns 10, 11, 12, 13 in parallel formed by an LED or a laser. The cleaning patch 14 first passes through a developing unit to absorb the residual toners thereon, so that the next developing step is not affected by the residual toners.

Figure 2:
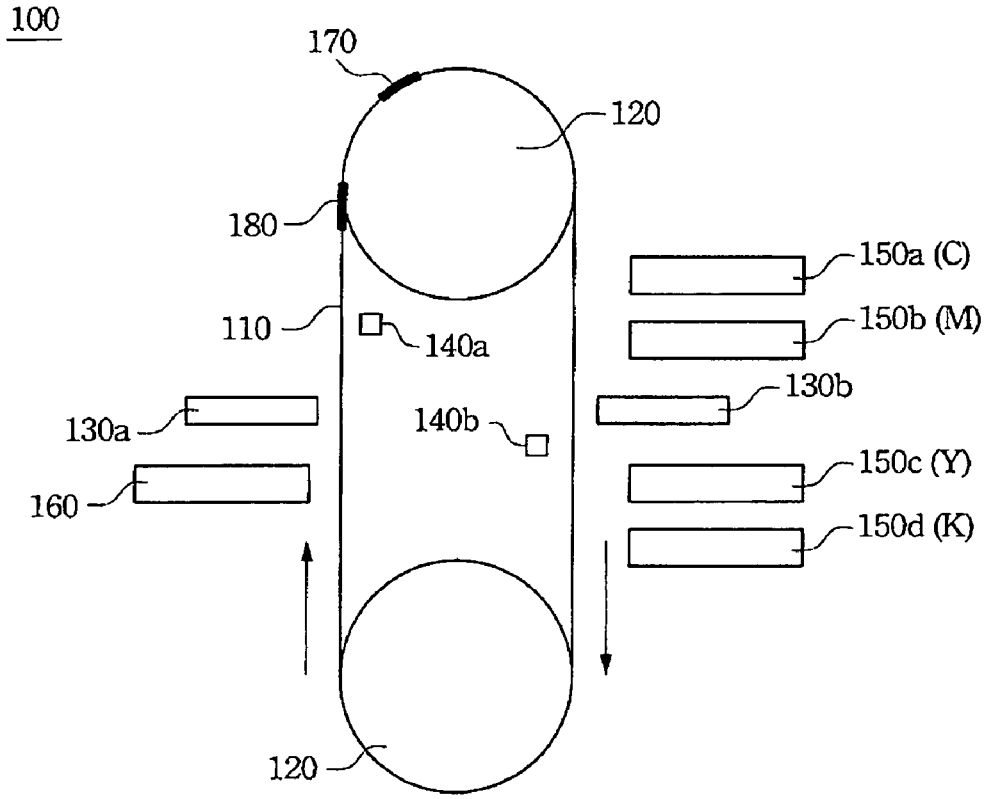
FIG. 2 is a schematic view of the photoreceptor of the electrophotographic image system in a preferred embodiment of the invention.

FIG. 2 is a schematic view of a color electrophotographic image system which requires two passes of the photoreceptor. The color electrophotographic image system 100 has a photoreceptor 110, a transmission roller 120, two charging units 130*a*, 130*b*, a cleaning station 160, two exposure elements 140*a*, 140*b*, and four developing unit: a cyan (C) developing unit 150*a*, a magenta (M) developing unit 150*b*, a yellow (Y) developing unit 150*c*, and a black (K) developing unit 150*d*. The photoreceptor 110 is fixed on the transmission roller 120 and has a belt structure. It rotates with the transmission roller 120 in the direction indicated by the arrow. The exposure elements 140*a*, 140*b* can be either a laser or an LED device.

To print the first color, cyan image as an example, a charging unit 130*a* evenly distributes negative charges on the photoreceptor 110. When the photoreceptor 110 rotates and passes the exposure element 140*a*, a cleaning patch 170 is first built on the photoreceptor 110 by the exposure element 140*a*. Afterwards, the photoreceptor 110 is exposed to form a latent image 180 based on the image data. Then, the cleaning patch 170 and the latent image 180 pass through the cyan developing unit 150*a* for developing. According to the present invention, the cleaning patch 170 first passes through the cyan developing unit 150*a* and the magenta developing unit 150*b* to absorb toners left thereon from the previous developing. Afterwards, the latent image 180 passes through the cyan developing unit 150*a*. The cyan developing unit 150*a* distribute toners onto the latent image 180. The toners absorbed on the cleaning patch 170 are removed using the cleaning station 160. The cleaning patch 170 can be disposed at the front end of the latent image position 180 on the photoreceptor 110 to completely remove the residual toners in the developing units.

Figure 3:
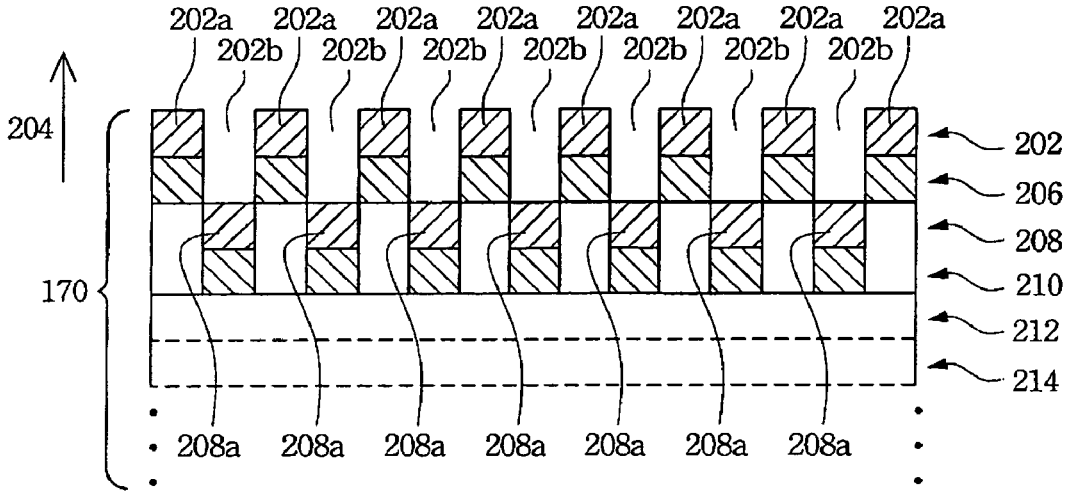
FIG. 3 is a schematic view of the cleaning patch according to the preferred embodiment of the invention.

FIG. 3 is the cleaning patch formed according to a preferred embodiment of the invention. Its major difference from the stripe cleaning patch 14 as shown in the FIG. 1 is in that the absorption region of each cleaning region on the cleaning patch 170 are disposed at intervals in order to reduce the volume of toner absorption in each cleaning region. This helps reduce the resistance in removing the toner from cleaning region by a cleaning station. For example, if the cleaning patch 170 passes through the developing unit in the direction of the arrow 204, the toner is absorbed in the absorption region 202*a* of the cleaning region 202 of the cleaning patch 170. The regions 202*b* do not absorb toners. The residual toners corresponding to the cleaning region 202*b* on the developing unit are absorbed by the absorption region 208*a* of the cleaning region 208.

Figure 4:
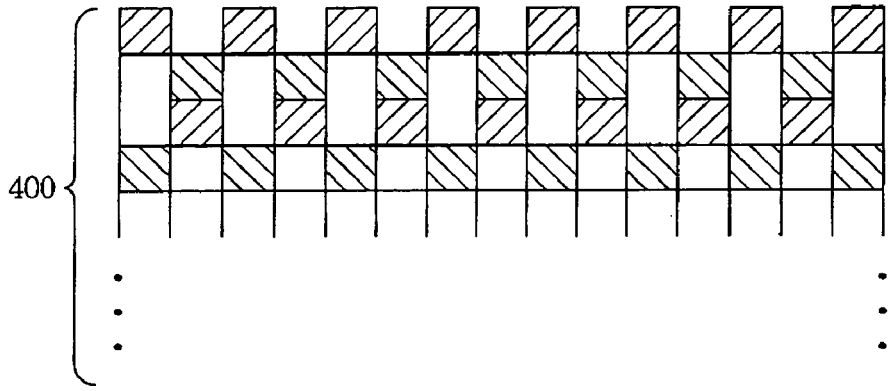
FIG. 4 shows the cleaning patch in another embodiment of the invention.
Figure 5:
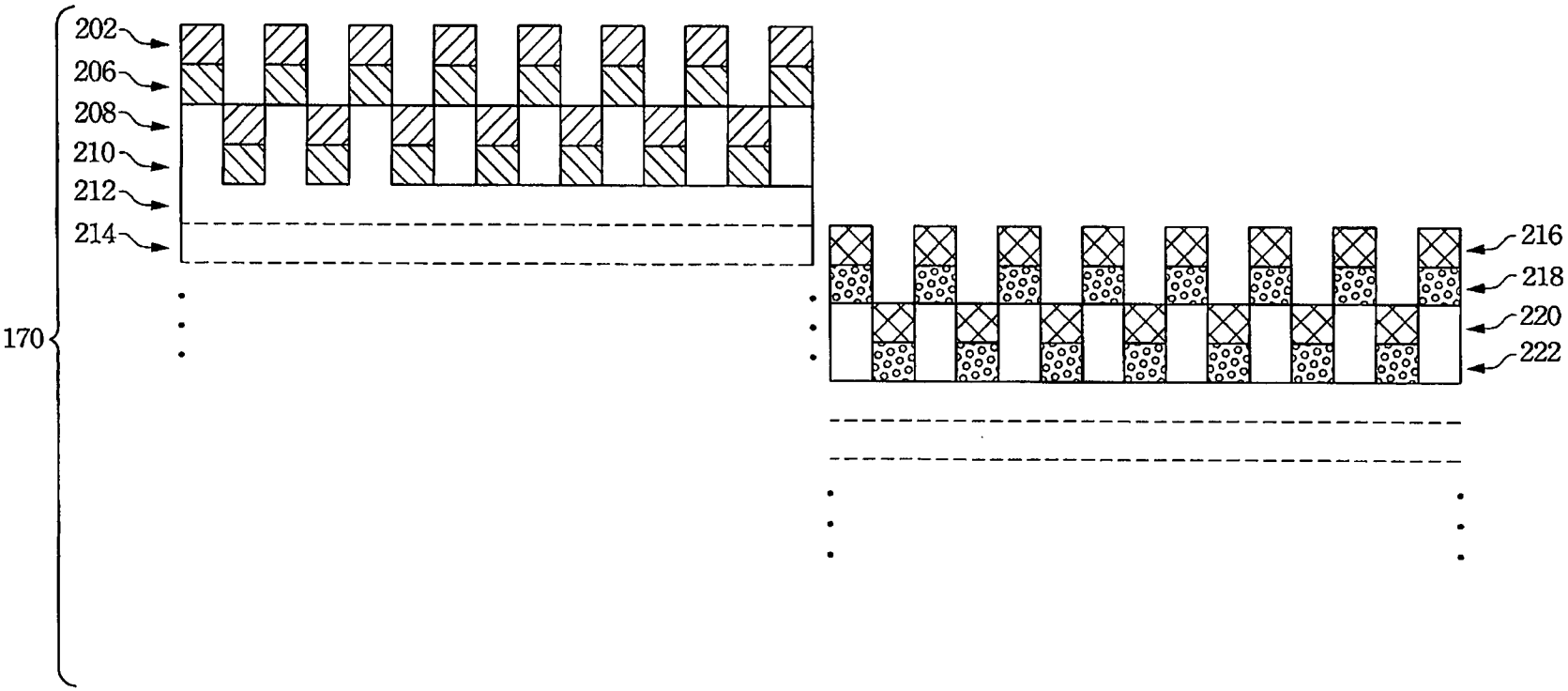
FIG. 5 is a schematic view of the cleaning patch according to the preferred embodiment of the invention.

In other words, the present invention uses the interval type cleaning region as shown in the FIG. 3 to evenly absorb the toners on the developing unit to improve the quality. This can effectively reduce the thickness of the toner absorption in each cleaning region. However, it should be noted that this pattern of the cleaning patch 170 is only one possible embodiment and is not meant to restrict the scope of the invention. The cleaning patch may have other patterns, such as straight stripes, squares, diagonal stripes, and any other geometric shapes that have separate toner cleaning regions, such as the one 400 shown in FIG. 4. Therefore, the invention discloses a cleaning patch formed by disposing toner absorption patterns alternately. The toner absorption quantity of each cleaning region can thus be reduced. This can effectively distribute the residual toners evenly in the cleaning patch. The absorbed residual toners will not accumulate in the front end of the cleaning patch. For example, if the area of the absorption region 202*a* and the absorption region 208*a* occupy one third and two thirds of the area of the cleaning regions 202 and 208, respectively, then the toner absorption quantities of each absorption region is also one third and two thirds of that of the stripe type cleaning region. The toner absorption quantities are relatively less in comparison with the stripe type cleaning patch. Therefore, the scraping resistance is also smaller than the stripe type cleaning patch. The pressured applied on the cleaning blade of the cleaning station can be greatly reduced, preventing the photoreceptor from damages.

Suppose the color electrophotographic image system shown in FIG. 2 is used to form the cleaning patch 170. First a high-voltage corona charging unit 130*a* distributes negative charges all over the surface of a photoreceptor 110. Afterwards, an exposure element 140*a* is used to expose the cleaning patch 170. For example, take an LED as the exposure element. The LED devices can be lit up alternatively to irradiate the negatively charged photoreceptor 110, forming the cleaning regions 202, 206, 208, and 210. The cleaning regions 202 and 208 are used to absorb the residual toners on a cyan developing unit 150*a*. The cleaning region 206 and 210 are used to absorb the residual toners on a magenta developing unit 150*b*.

More cleaning regions (212 and 214) are built to cleaning the remaining toner on the developing units. It should be noted that the additional cleaning regions 212, 214 can be straight stripes or alternate patterns since most of the residual toners on the developing unit are removed by the cleaning regions 202, 206, 208, 210. In other words, the user can adjust the cleaning regions. However, for the first cleaning region that passes through a developing unit, its pattern is preferably arranged in a complementary way, such as the cleaning regions 202 and 208 in FIG. 3. This can effectively reduce the toner absorption on a single cleaning region.

To clean the residual toners on a yellow developing unit 150*c* and a black developing unit 150*d* can be achieved using the above-mentioned pattern. As shown in FIG. 2, a high-voltage corona charging unit 130*b* first distributes negative charges all over the surface of a photoreceptor 110. An exposure element 140*b* is used to expose the cleaning patch 170. Likewise, the LED devices are lit up alternately to irradiate the negatively charged photoreceptor 110, forming the cleaning regions 216, 218, 220, and 222. The cleaning region 216 and 220 are used to absorb the residual toners on the yellow developing unit 150*c*. The cleaning region 218 and 222 are used to absorb the residual toners on the black developing unit 150*d*.

It should be noted that the cleaning regions of the yellow developing unit 150*c* and the black developing unit 150*d* in this embodiment are stacked on the cleaning region 214. That is, they are stacked on the cleaning regions that absorb less residual toners on the developing unit 150*a* and 150*b*. This can effectively reduce the length of the cleaning patch 170. Note that the pattern of the cleaning patch for absorbing the developing unit 150*a* and 150*b* and the pattern of the cleaning patch for absorbing the developing unit 150*c* and 150*d* can be different. For example, the pattern of the cleaning patch for absorbing the developing unit 150*c* and 150*d* may use the cleaning patch pattern shown in FIG. 4. The exposure elements 140*a* and 140*b* can be laser devices. The setting of shortening the length of the cleaning region 214 can be predetermined via the image forming device or arbitrarily set via an appropriate control interface.

In summary, the disclosed cleaning patch has at least one cleaning region formed in an alternate way on a photoreceptor. By changing the sizes and the patterns of different absorption regions in each cleaning region, the toner absorption of each cleaning region is reduced for minimizing the resistance when cleaning the toners. In accordance with a preferred embodiment of the invention, the cleaning region for cleaning a developing unit has an absorption pattern that is formed with an alternate pattern between two cleaning regions. Therefore, for a single cleaning region, the toner absorption quantity is less than having straight stripe toner absorption patterns distributed all over the cleaning patch. Therefore, the scraping resistance in this case is also relatively smaller than the straight stripe cleaning patch. This can avoid damages to the photoconductor while removing the toner from the cleaning patch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cleaning patch formed on a photoreceptor of an image forming device for cleaning residual toners on at least one developing means, the cleaning patch comprising:

at least two cleaning regions sequentially formed on the photoreceptor for cleaning the residual toners on the developing means, wherein said two cleaning regions have alternating cleaning patterns and the cleaning regions absorb the residual toners on different developing means.

2. The cleaning patch of claim 1, wherein the photoreceptor is a belt.

3. The cleaning patch of claim 1, wherein the pattern is selected from the group consisting of straight stripes, a square, and a diagonal stripe.

4. The cleaning patch of claim 3, wherein the position and pattern of the cleaning patches are predetermined.

5. A method of forming a cleaning patch on a photoreceptor of an image forming device for cleaning residual toners on a developing means, the method comprising the steps of:

forming a charging region on the photoreceptor; and exposing part of the charging region to form a cleaning patch having at least two cleaning regions on the photoreceptor, wherein said two cleaning regions have alternating cleaning patterns and the cleaning regions absorb the residual toners on different developing means.

6. The method of claim 5, wherein the photoreceptor is a belt.

7. The method of claim 5, wherein the cleaning pattern is selected from the group consisting of a straight stripe, a square and a diagonal stripe.

8. The method of claim 7, wherein the position and pattern of the cleaning patch are predetermined.

9. A method of forming a cleaning patch on a photoreceptor of an image forming device for cleaning residual toners on a developing means, the method comprising the steps of:

charging a surface of the photoreceptor by a charging unit to form a charging region;

exposing a first part of the charging region by an exposure element to form a first cleaning region on the photoreceptor; and exposing a second part of the charging region by the exposure element to form a second cleaning region on the photoreceptor, wherein said first and second cleaning regions have different patterns, wherein said first and second cleaning regions have alternating patterns and said first and second cleaning regions absorb the residual toners on different developing means.

10. The method of claim 9, wherein said first and second cleaning regions are disposed at intervals.

11. A method of forming a cleaning patch on a photoreceptor of an image forming device for cleaning residual toners on a developing means, the method comprising the steps of:

charging a surface of the photoreceptor by a charging unit to form a charging region;

exposing a first part of the charging region by an exposure element to form a first cleaning region on the photoreceptor; and exposing a second part of the charging region by the exposure element to form a second cleaning region on the photoreceptor, wherein said first and second cleaning regions have alternating patterns and, wherein the area size of the first and second cleaning regions is different.

12. A method of forming a cleaning patch on a photoreceptor of an image forming device for cleaning residual toners on a developing means, the method comprising the steps of:

charging a surface of the photoreceptor by a charging unit to form a charging region;

exposing a first part of the charging region by an exposure element to form a first cleaning region on the photoreceptor; and exposing a second part of the charging region by the exposure element to form a second cleaning region on the photoreceptor, wherein said first and second cleaning regions have alternating patterns and, wherein the exposure element comprises a plurality of light-emitting diodes which are lit up alternately to expose the charging region on the photoreceptor to form the first and the second cleaning regions.

* * * * *

UNITED STATES PATENT AND TRADEMARK OFFICE

CERTIFICATE OF CORRECTION

PATENT NO. : 7,260,341 B2
APPLICATION NO. : 11/337621
DATED : August 21, 2007
INVENTOR(S) : Chang It is certified that error appears in the above-identified patent and that said Letters Patent is hereby corrected as shown below:

Title Page; item (73); should read: The name of the Assignee should be Aetas System Incorporated.

Signed and Sealed this

Eighteenth Day of December, 2007

JON W. DUDAS
*Director of the United States Patent and Trademark Office*